US009172151B2

(12) United States Patent
Sato

(10) Patent No.: US 9,172,151 B2
(45) Date of Patent: Oct. 27, 2015

(54) STRUCTURE FOR CONNECTING ELECTRIC WIRE TO CRIMP TERMINAL

(75) Inventor: Kei Sato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/697,657

(22) PCT Filed: Apr. 14, 2011

(86) PCT No.: PCT/JP2011/059315
§ 371 (c)(1),
(2), (4) Date: Jan. 3, 2013

(87) PCT Pub. No.: WO2011/142205
PCT Pub. Date: Nov. 17, 2011

(65) Prior Publication Data

US 2013/0130569 A1 May 23, 2013

(30) Foreign Application Priority Data

May 14, 2010 (JP) ..... 2010-112484

(51) Int. Cl.
*H01R 4/20* (2006.01)
*H01R 4/18* (2006.01)

(52) U.S. Cl.
CPC ..... *H01R 4/206* (2013.01); *H01R 4/185* (2013.01); *H01R 4/188* (2013.01)

(58) Field of Classification Search
CPC ..... H01R 4/188; H01R 4/185; H01R 4/184; H01R 4/22; H01R 4/206; H01R 4/183
USPC ..... 439/887, 882, 884, 877
See application file for complete search history.

(56) References Cited

U.S. PATENT DOCUMENTS 2,815,497 A * 12/1957 Redslob ..... 439/203
3,137,925 A * 6/1964 Wahl ..... 29/873

(Continued)

FOREIGN PATENT DOCUMENTS

DE 10 2005 016 236 A1 10/2005
EP 2 273 618 A1 1/2011

(Continued)

OTHER PUBLICATIONS

International Search Report (PCT/ISA/210) dated May 17, 2011 issued by the International Searching Authority in counterpart International Application No. PCT/JP2011/059315.

(Continued)

*Primary Examiner* — Briggitte R Hammond
(74) *Attorney, Agent, or Firm* — Sughrue Mion, PLLC

(57) ABSTRACT

A metallic cover having at one longitudinal end thereof a half pipe region having a circular-arc cross sectional shape and at other longitudinal end thereof an annular region having a substantially circular cross sectional shape is fitted to a conductor at an end of an electric wire. The half pipe region is situated at a leading end of the conductor so as to cover a space above the conductor, and the annular region is fitted around an outer periphery of the conductor. The end of the electric wire equipped with the cover is set on a bottom plate of an electric wire connecting region while the conductor exposed outside an open area of the half pipe region remains oriented toward the bottom plate. Conductor crimping pieces and sheath crimping pieces are folded inward in that state, thereby being crimped and crimped.

8 Claims, 10 Drawing Sheets

(56) References Cited

U.S. PATENT DOCUMENTS

| | | | | |
|---|---|---|---|---|
| 3,656,092 | A * | 4/1972 | Swengel et al. | 439/730 |
| 3,955,044 | A * | 5/1976 | Hoffman et al. | 174/84 C |
| 5,035,655 | A * | 7/1991 | Hesse | 439/699.2 |
| 5,157,853 | A * | 10/1992 | Piana et al. | 40/316 |
| 5,749,756 | A * | 5/1998 | Vockroth et al. | 439/879 |
| 2005/0227549 | A1 | 10/2005 | Takayama | |
| 2005/0227550 | A1 | 10/2005 | Takayama | |
| 2005/0287875 | A1 | 12/2005 | Kojima | |

FOREIGN PATENT DOCUMENTS

| | | | |
|---|---|---|---|
| JP | 1973-114083 | U | 12/1973 |
| JP | 1991-055663 | U | 5/1991 |
| JP | 2004-207172 | A | 7/2004 |
| JP | 2005-353334 | A | 12/2005 |
| JP | 2010-061906 | A | 3/2010 |

OTHER PUBLICATIONS

Written Opinion (PCT/ISA/237) dated May 17, 2011 issued by the International Searching Authority in counterpart International Application No. PCT/JP2011/059315.

Office Action, Issued by the State Intellectual Property Office of P.R. China, Dated Aug. 21, 2014, in counterpart Chinese Application No. 201180024023.0.

* cited by examiner

STRUCTURE FOR CONNECTING ELECTRIC WIRE TO CRIMP TERMINAL

TECHNICAL FIELD

The present invention relates to a structure for connecting an electric wire to a crimp terminal.

BACKGROUND ART

FIGS. 11(*a*) to (*c*) show a structure for connecting an electric wire to a terminal described in connection with Patent Document 1.

First, as shown in FIG. 11(*a*) and FIG. 11(*b*), in relation to a structure for connecting an electric wire to a terminal, a metallic, saclike cap 230 of a size to cover an area ranging from a conductor Wa (made up primarily of a stranded wire created by twisting a plurality of wires) stripped by peeling off an insulating sheath Wb to a portion of an electric wire covered with the insulating sheath Wb is attached to an end of an electric wire W. The conductor Wa at the end of the electric wire W covered with the cap 230 is put on a bottom plate 221 of a wire connecting region 212 formed in a rear of the terminal 210. In this state, as shown in FIG. 11(*c*), a pair of conductor crimping pieces 222 extending upward from both side edges of the bottom plate 221 are folded inward so as to warp the conductor Wa and the cap 230 and then crimped and fixed such that the conductor Wa and the cap 230 are brought into close contact with an upper surface of the bottom plate 221.

In the cap 230, a portion 231 that fits around an outer periphery of the conductor Wa is formed into a small-diameter cylindrical shape, and an entrance-side portion 232 that fits around an outer periphery of the insulating sheath Wb is formed into a large-diameter cylindrical shape. A clearance gap existing between the conductor Wa and the cap 230 is filled with a (un-illustrated) waterproof filler. Serrations 228 for enhancing contact conduction between the cap 230 and the terminal 210 are provided on an internal periphery of the wire connecting region 212 of the terminal 210.

The cap 230 is used here for the following reasons. For instance, provided that the conductor Wa of the electric wire W is made of aluminum or an aluminum alloy and that the terminal 210 is made of copper or a copper alloy, if a water content adheres to a contact are (i.e., a crimping region) between dissimilar metals, electrical corrosion may occur. In order to prevent this, a material of the cap 230 is set to a substance of the same type (copper or the copper alloy) as that of the terminal 210. Although either a terminal made of aluminum or a terminal made of an aluminum alloy can also be used for an aluminum wire, both the terminal 210 and the cap 230 are made of copper or a copper alloy for reasons that a terminal made of copper or a terminal made of a copper alloy has an advantage in strength. When the material is selected as mentioned above, the cap 230 and the conductor Wa of the electric wire W become dissimilar metals (the cap is made of copper or a copper alloy, and the conductor is made of aluminum or an aluminum alloy). However, the clearance gap between the conductor Wa and the cap 230 is filled with the filler as mentioned above, to thereby prevent intrusion of the water content into the cap 230. Accordingly, a fear of electrical corrosion has hitherto been said to be eliminated.

A tubular cap is normally used as the cap 230. A cap subjected to drawing or cutting so as to close its leading end is usually used.

RELATED ART DOCUMENT

Patent Document

Patent Document 1: JP-A-2004-207172

SUMMARY OF THE INVENTION

Problems to be solved by the Invention

Incidentally, when a cap manufactured by drawing or a cap manufactured by cutting is used as in the case of a related-art connecting structure, the machining techniques are more sophisticated than normal press working and inferior to the same in terms of productivity and hence have been a cause of a cost increase.

Moreover, the conductor Wa of the electric wire W is fully covered with the cap 230, to thus implement a structure that prevents occurrence of a direct contact between the conductor Wa and the terminal 210. Therefore, electrical connectivity between the terminal 210 and the electric wire W sometimes becomes worse depending on; for instance, a type of the material of the cap 230 or a type of the filler poured in the cap 230.

The present invention has been conceived in light of the circumstance and aims at providing a structure for connecting a crimp terminal to an electric wire that makes it possible to improve electrical connectivity between a terminal and an electric wire and pursue cost cutting while inhibiting corrosion, which would otherwise be caused by adhesion of a water content, by reducing an exposed conductor of an electric wire.

Means for Solving the Problems

In order to accomplish the objective, a structure for connecting a crimp terminal to an electric wire of the present invention has characteristics (1) to (4) provided below.

(1) A structure for connecting an electric wire to a crimp terminal, the crimp terminal comprising:

in its front portion of the crimp terminal, an electric connecting region that is to be connected with a counterpart terminal; and in its rear portion of the crimp terminal, an electric wire connecting region that is formed so as to assume a substantially U-shaped form when viewed in cross section, and including a bottom plate and a pair of electric wire crimping pieces extended upward from both side edges of the bottom plate and that are folded inward so as to wrap an end of an electric wire to be connected so as to bring the end of the electric wire into close contact with an upper surface of the bottom plate;

wherein a metallic cover having a half pipe region having a circular-arc cross sectional shape at one longitudinal end thereof and an annular region having a substantially circular cross sectional shape at other longitudinal end thereof is fitted to a conductor exposed by removal of an insulating sheath from the end of the electric wire so that the half pipe region is situated at a leading end of the conductor so as to cover a space above the conductor; and the annular region is fitted around an outer periphery of the conductor; and wherein in a state the end of the electric wire equipped with the cover is set on the bottom plate of the electric wire connecting region while the conductor exposed outside an open area of the half pipe region is oriented toward the bottom plate, the pair of electric wire crimping pieces of the electric wire connecting region are folded inward and crimped so as to crimp the end of the electric wire to the electric wire connecting region along with the cover.

(2) In the structure for connecting an electric wire to a crimp terminal configured as described in connection with (1), the half pipe region includes a semi-circular cross sectional shape and is placed on the conductor so as to cover an upper half of a cross section of the conductor.

(3) In the structure for connecting an electric wire to a crimp terminal configured as described in connection with (1) or (2), the cover is formed by pressing a single plate material, and there is ensured a clearance gap between peripheral edges of the plate material circularly rounded to make up the annular region.

(4) In the structure for connecting an electric wire to a crimp terminal configured as described in connection with any one of (1) to (3), serrations are provided on an interior surface of the electric wire connecting region of the terminal and an interior surface of the cover.

In the structure for connecting an electric wire to a crimp terminal having the configuration described in connection with (1), there is employed the metallic cover as means for covering an exposed portion of the conductor of the electric wire, wherein the metallic cover has at its one end the half pipe region having a circular-arc cross sectional shape and at other end the annular region having a substantially circular cross sectional shape. A cover manufactured by pressing a single plate material or a cover manufactured by simply cutting a pipe can be used as the cover. Therefore, it becomes possible to use a cover manufactured by means of a manufacturing technique cheaper than techniques used for manufacturing existing caps, so that cost cutting can be pursued. Since the cover can cover the exposed portion of the conductor, intrusion of a water content into the conductor from the outside can be prevented, and a fear of corrosion of the exposed portion of the conductor can be eliminated.

Moreover, since the conductor exposed outside the open area of the half pipe region can be brought into direct contact with the interior surface of the electric wire connecting region of the crimp terminal, electrical connectivity between the crimp terminal and the electric wire can be enhanced without regard to the type of a material of the cover. Further, since the half pipe region assumes a circular-arc shape, the half pipe region becomes easier to collapse when the conductor crimping pieces are crimped. Therefore, contact conduction between the cover and the conductor of the electric wire can be enhanced. As a consequence, the electric connectivity between the crimp terminal and the conductor can be improved.

Furthermore, since the cover has the annular region, the cover can be fitted to the end of the electric wire so as not to fall by fitting the annular region around the outer periphery of the conductor of the electric wire. Thus, workability achieved when the end of the electric wire is set to the crimp terminal can be improved. In addition, the annular region is fitted around the outer periphery of the conductor, whereby a step existing between the insulating sheath and the conductor of the electric wire can be reduced by means of the thickness of the annular region. Accordingly, crimping of the electric wire crimping pieces of the electric wire connecting region becomes easy to perform.

In the structure for connecting an electric wire to a crimp terminal having the configuration described in connection with (2), since the half pipe region assumes a semicircular shape, a superior contact between the conductor of the electric wire and the half pipe of the cover and a superior contact between the conductor and the terminal can be acquired. Because the half pipe region covers an upper half of the conductor, intrusion of the water content from the outside can be sufficiently inhibited.

In the structure for connecting an electric wire to a crimp terminal having the configuration described in connection with (3), the cover is formed by pressing a single plate material. There is ensured a clearance gap between the peripheral ends of the plate material circularly rounded to make up the annular region. Accordingly, it is possible to assure a degree of freedom achieved when the annular region is fitted around the conductor of the electric wire and ease of collapse achieved when the terminal is crimped.

In the structure for connecting an electric wire to a crimp terminal having the configuration described in connection with (4), since the serrations are provided on the interior surface of the electric wire connecting region of the terminal, contact conduction between the terminal and the conductor and contact conduction between the cover and the conductor can be enhanced.

Advantage of the Invention

According to the present invention, electrical connectivity between the terminal and the electric wire can be enhanced while inhibiting corrosion, which would otherwise be caused by adhesion of water content, by reducing an exposed conductor of the electric wire, and cost cutting can be pursued. Moreover, the conductor exposed outside the open area of the half pipe region of the cover can be brought into direct contact with the interior surface of the electric wire connecting region of the terminal. Accordingly, electrical connectivity between the terminal and the electric wire can be enhanced without regard to a type of a material of the cover. Moreover, since the half pipe region is easy to collapse at the time of crimping of the electric wire crimping pieces. Hence, contact conduction between the cover and the conductor of the electric wire can be enhanced. This also contributes to enhancement of electric connectivity between the terminal and the conductor. Further, since the cover is equipped with the annular region, the cover can be fitted to the end of the electric wire so as not to fall by fitting the annular region around an outer periphery of the conductor of the electric wire. Workability achieved when the end of the electric wire is set to the terminal can be enhanced.

The present invention has been briefly described thus far. Details of the present invention will be more clarified by reading through embodiments for implementing the present invention, which will be described below, by reference to the accompanying drawings.

MODE FOR CARRYING OUT THE INVENTION

Embodiments of the present invention are hereunder described by reference to the drawings.

Figure 1A:
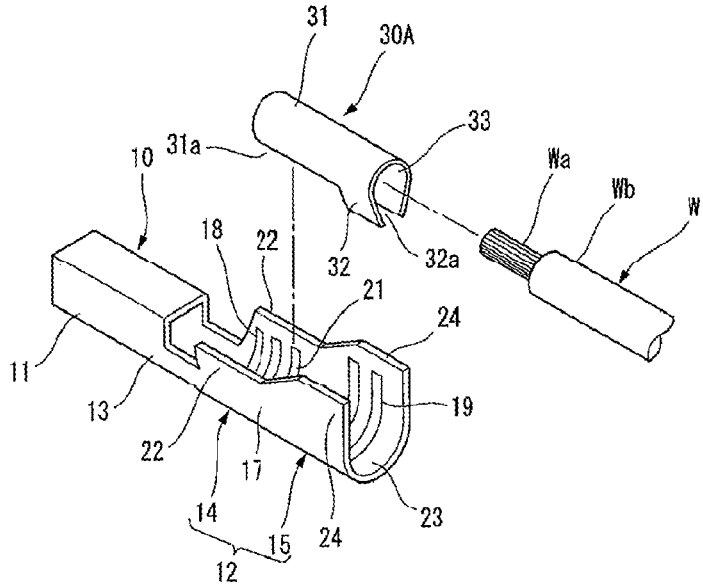
FIGS. 1(*a*) and (*b*) are perspective views showing a state of a terminal of an embodiment of the present invention achieved before it is crimped, FIG. 1(*a*) is a view showing a state achieved before a cover is fitted to an end of an electric wire, and FIG. 1(*b*) is a view showing a state achieved after the cover is fitted to the end of the electric wire.
Figure 1B:
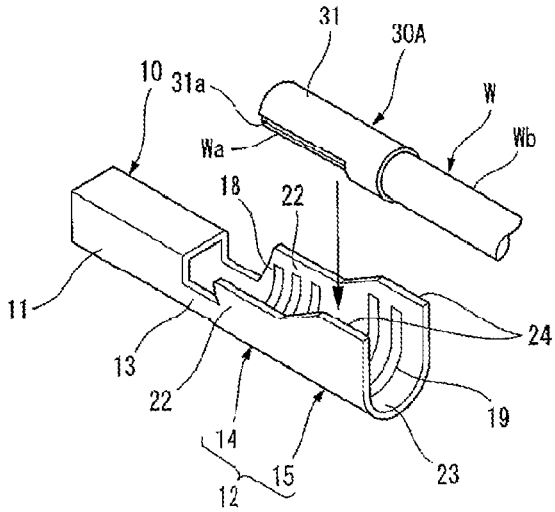
Figure 2A:
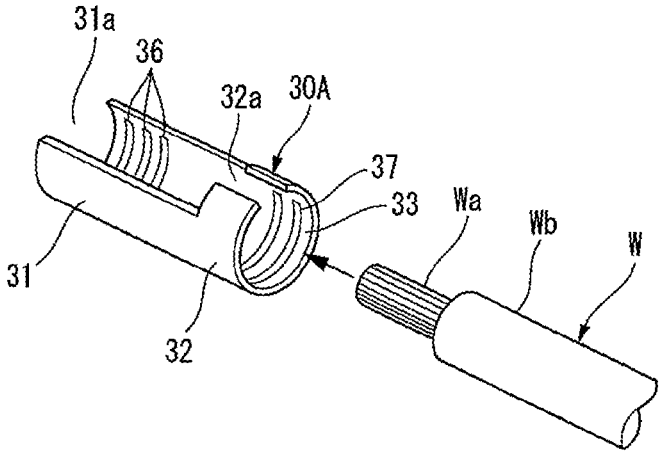
FIGS. 2(*a*) to (*c*) are views showing a relationship between the cover and the end of the electric wire, FIG. 2(*a*) is a view showing a state achieved before the end of the electric wire is fitted into the cover when seen from below the cover, FIG. 2(*b*) is a side view showing a state in which the cover is fitted around the end of the electric wire, and FIG. 2(*c*) is a side view of the end of the electric wire.
Figure 2B:
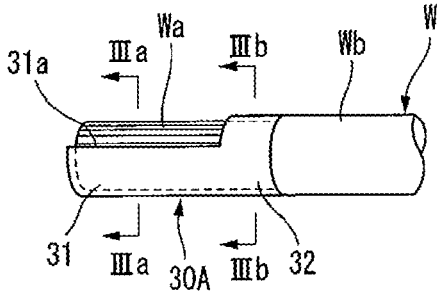
Figure 2C:
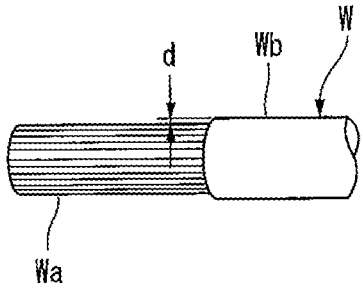
Figure 3A:
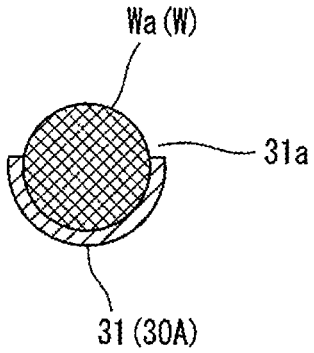
FIG. 3(*a*) is a cross section achieved when viewed in a direction of arrows IIIa-IIIa shown in FIG. 2(*b*), FIG. 3(*b*) is a cross section achieved when viewed in a direction of arrows IIIb-IIIb shown in FIG. 2(*b*), and FIG. 3(*c*) is a view showing a modification of a portion shown in FIG. 3(*b*).
Figure 3B:
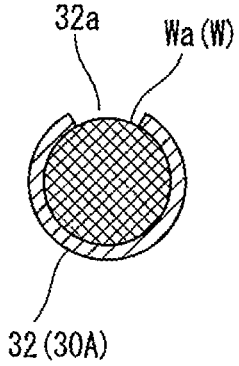
Figure 3C:
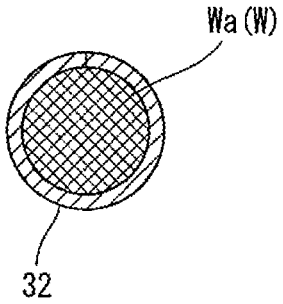
Figure 4A:
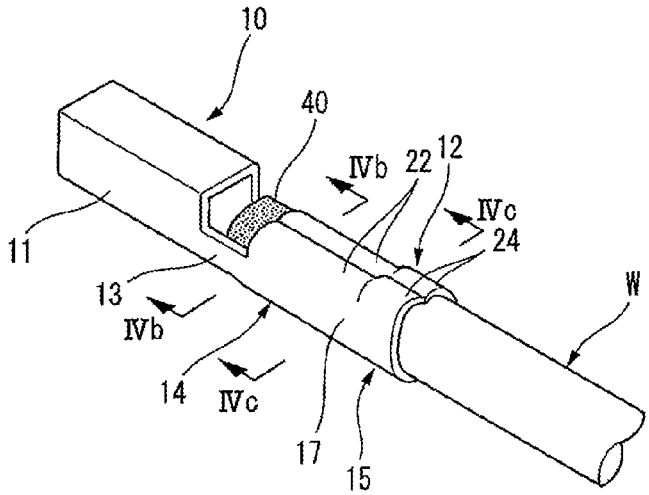
FIGS. 4(*a*) to (*c*) are views showing a state achieved after the end of the embodiment of the present invention is crimped, FIG. 4(*a*) is a perspective view, FIG. 4(*b*) is a cross section achieved when viewed in a direction of arrows IVb-IVb shown in FIG. 4(*a*), and FIG. 4(*c*) is a cross section achieved when viewed in a direction of arrows IVc-IVc shown in FIG. 4(*a*).
Figure 4B:
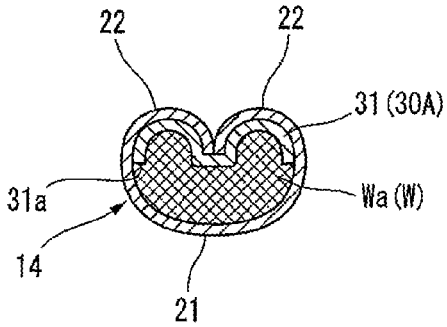
Figure 4C:
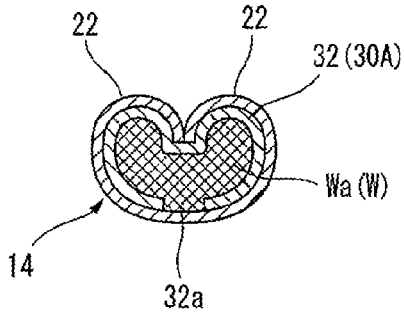

FIGS. 1(*a*) and (*b*) are perspective views showing a state of a terminal of an embodiment of the present invention achieved before it is crimped, FIG. 1(*a*) is a view showing a state achieved before a cover is fitted to an end of an electric wire, and FIG. 1(*b*) is a view showing a state achieved after the cover is fitted to the end of the electric wire. FIGS. 2(*a*) to (*c*) are views showing a relationship between the cover and the end of the electric wire, FIG. 2(*a*) is a view showing a state achieved before the end of the electric wire is fitted into the cover when seen from below the cover, FIG. 2(*b*) is a side view showing a state in which the cover is fitted around the end of the electric wire, and FIG. 2(*c*) is a side view of the end of the electric wire. FIG. 3(*a*) is a cross section achieved when viewed in a direction of arrows IIIa-IIIa shown in FIG. 2(*b*), FIG. 3(*b*) is a cross section achieved when viewed in a direction of arrows IIIb-IIIb shown in FIG. 2(*b*), and FIG. 3(*c*) is a view showing a modification of a portion shown in FIG. 3(*b*). FIGS. 4(*a*) to (*c*) are views showing a state achieved after the end of the embodiment of the present invention is crimped, FIG. 4(*a*) is a perspective view, FIG. 4(*b*) is a cross section achieved when viewed in a direction of arrows IVb-IVb shown in FIG. 4(*a*), and FIG. 4(*c*) is a cross section achieved when viewed in a direction of arrows IVc-IVc shown in FIG. 4(*a*).

As shown in FIG. 1(*a*) and FIG. 1(*b*), a crimp terminal 10 employed here is of female type. The crimp terminal has in its front portion a box-shaped electric connecting region 11 that is to be connected to its (un-illustrated) counterpart crimp terminal, or the like, and that incorporates a spring piece and also has in its rear portion, by way of a joint 13, an electric wire connecting region 12 to be crimped to an end of an electric wire W.

An electric wire connecting region 12 has a conductor crimping region 14 situated on the front side and a sheath crimping region 15 situated behind the conductor crimping region 14. The conductor crimping region 14 situated on the front side is formed from a bottom plate 21 and a pair of conductor crimping pieces (electric wire crimping pieces) 22, to thus assume a substantially U-shaped form achieved when viewed in the direction of arrows. The pair of conductor crimping pieces 22 extend upward from both side edges of the bottom plate 21 and are folded inward so as to wrap a conductor Wa stripped by peeling off an insulating sheath (hereinafter also called simply a "sheath") Wb of an end of an electric wire W to be connected, thereby crimping the conductor Wa so as to be held in close contact with an upper surface of the bottom plate 21. The crimping region 15 situated on the rear side is formed from a bottom plate 23 and a pair of sheath crimping pieces (electric wire crimping pieces) 24, to thus assume a substantially U-shaped cross section achieved when viewed in the direction of arrows. The pair of sheath crimping pieces 24 extend upward from both side edges of the bottom plate 23 and are folded inward so as to wrap an insulation sheath Wb at the end of the electric wire W to be connected, thereby crimping the insulation sheath Wb so as to be held in close contact with an upper surface of the bottom plate 23.

An area ranging from the bottom plate 21 of the conductor crimping region 14 to the bottom plate 23 of the sheath crimping region 15 is continually formed as a common bottom plate. A pair of casing walls 17 are formed between the conductor crimping pieces 22 of the conductor crimping region 14 and the sheath crimping pieces 24 of the sheath crimping region 15 as walls continually existing between the conductor crimping pieces 22 and the sheath crimping pieces 24. The casing walls 17 experience plastic deformation so as to cover an area between the conductor crimping region 14 and the sheath crimping region 15 in association with crimping of the conductor crimping pieces 22 and the sheath crimping pieces 24. A plurality of serrations (groove-like irregularities) 18 extending in a direction crossing a longitudinal direction of the electric wire W are provided on an interior periphery of the conductor crimping region 14. In additions, serrations (groove-like irregularities) 19 extending in a direction crossing the longitudinal direction of the electric wire W are provided on an interior periphery of the sheath crimping region 15, as well.

In order to obtain the connecting structure of the embodiment, a metallic cover 30A, such as that shown in FIG. 1(*a*) and FIG. 2(*a*), is employed. In the present invention, the cover 30A is formed from metal (e.g., copper) that is of the same type as that of the crimp terminal 10. A half pipe region 31 having a circular-arc cross sectional shape is provided at one longitudinal end of the cover, and an annular region 32 having a substantially circular cross sectional shape is provided at the other longitudinal end of the same. In the present embodiment, the half pipe region 31 of the cover 30A is formed in a semi-circular shape.

The cover 30A is made by pressing one plate material, and the annular region 32 has a clearance gap 32*a* between peripheral edges of the plate material rounded into a substantially-circular shape. In this case, the half pipe region 31 is formed as a semi-cylindrical body by removing as an open area 31*a* a peripheral wall that is a half perimeter or more of a cylindrical body fitting around an outer periphery of the conductor Wa of the electric wire W, to thus leave a peripheral wall that is a remaining half perimeter or less. Both peripheral edges of the half pipe region 31 are parallel to an axial direction of the cylindrical body. The annular region 32 is a cylindrical region formed from a peripheral wall that is a half perimeter or more of the cylindrical body. The clearance gap 32*a* exists in a portion of the annular region 32 in its peripheral direction, and an interior of the clearance gap defines a space 33 that allows insertion of the conductor Wa of the conductor W. Although the clearance gap 32*a* can also be made large or small, the clearance gap is set to a size not to exceed a half perimeter of the cylindrical body corresponding to an outer diameter of the conductor Wa of the electric wire W. Further, a thickness of a material of the cover 30A is set to a value close to a thickness of an insulating sheath Wb of the electric wire W.

An overall length of the cover 30A (i.e., a dimension from the end of the annular region 32 to the end of the half pipe region 31) is set so as to become substantially equal to a length of the exposed conductor Wa at the end of the electric wire W. A single or a plurality of serrations (groove-like irregularities) 36, 37 extending in a direction crossing the longitudinal direction are provided on an internal periphery of the cover 30A.

In order to acquire the connecting structure described in connection with the present embodiment, the sheath Wb is removed, to thus expose the conductor Wa of previously determined length at the end of the electric wire W. Next, the conductor Wa is inserted into the space 33 of the annular region 32 of the metallic cover 30A. As shown in FIG. 1(*b*) and FIG. 2(*b*), an end face of the annular region 32 of the cover 30A is caused to butt against an end face of the sheath Wb. As above, as a result of the cover 30A being fitted around the end of the electric wire W, the diameter of the conductor Wa becomes greater by an amount corresponding to the thickness of the annular region 32. Therefore, a step "d" existing between the conductor Wa and the insulating sheath Wb in FIG. 2(*c*) can be reduced.

In this state, as shown in FIG. 1(*b*), the half pipe region 31 covers an upper cross section of the leading end of the conductor Wa of the electric wire W; namely, an upper half of the conductor Wa achieved when the cover is placed on the crimp terminal 10, and the conductor Wa is exposed outside the open area 31*a* of the half pipe region 31. FIG. 2(*b*) and FIG. 3(*b*) show upside down an orientation of the cover achieved when the cover is placed on the crimp terminal 10. As shown in FIG. 3(*b*), the annular region 32 is fitted around the outer periphery of the conductor Wa, the cover 30A is retained so as not to fall. In this case, since the clearance gap 32*a* is opened in a portion of the annular region 32 in its peripheral direction, the annular region 32 can be readily fitted around the outer periphery of the conductor Wa. As will be described later, as shown in FIG. 3(*c*), the annular region 32 can also be formed into a cylindrical shape whose whole circumference is continual by means of letting the peripheral ends of the annular region butt against each other so as not to create the clearance gap 32*a*.

As shown in FIG. 1(*b*), the end of the electric wire W equipped with the cover 30A is set on the electric wire connecting region 12 of the crimp terminal 10. On this occasion, the end of the electric wire W equipped with the cover 30A is put on upper surfaces of the respective bottom plates 21, 23 of the electric wire connecting region 12 of the crimp terminal 10 while the conductor Wa exposed outside the open area 31*a* of the half pipe region 31 remains oriented toward the bottom plate 21 of the conductor crimping region 14. In this state, the conductor crimping pieces 22 of the conductor crimping region 14 of the electric wire connecting region 12 and the sheath crimping pieces 24 of the sheath crimping region 15 are folded inward and crimped so as to enclose the end of the electric wire W. As shown in FIG. 4(*a*) to FIG. 4(*c*), the cover 30A and the conductor Wa of the electric wire are collapsed and deformed. An anticorrosive 40 is applied to a leading end of the conductor Wa after crimping, thereby producing a connecting structure of the present embodiment in which the electric wire W and the crimp terminal 10 are connected together.

In the thus-configured structure for connecting the electric wire W to the crimp terminal 10, there is employed the metallic cover 30A as means for covering an exposed portion of the conductor Wa of the electric wire W, wherein the metallic cover 30A has at its one end the half pipe region 31 having a circular-arc cross sectional shape and at its other end the annular region 32 having a substantially circular cross sectional shape. Accordingly, any covers manufactured by means of time-consuming techniques, such as drawing and cutting, are not used for the cover 30A, and a cover manufactured by pressing a single plate material can be used instead. Therefore, cost cutting can be pursed by use of the cover 30A that is cheaper than existing caps. Further, since the cover 30A can fully cover the exposed portion of the conductor Wa, intrusion of a water content into the cover from the outside can be prevented, and a fear of corrosion of the exposed portion of the conductor Wa can be eliminated.

Since the conductor Wa exposed outside the open area 31*a* of the half pipe region 31 can be brought into direct contact with the area of the interior surface of the electric wire connecting region 12 of the crimp terminal 10 where the serrations 18 are formed, electrical connectivity between the crimp terminal 10 and the electric wire W can be enhanced without regard to the type of a material of the cover 30A. Moreover, since the half pipe region 31 assumes a circular-arc cross sectional shape, the half pipe region becomes easier to collapse than does the cap where the cylindrical peripheral wall exists when the conductor crimping pieces 22 are crimped as shown in FIG. 4(*b*). Contact conduction between the cover 30A and the conductor Wa of the electric wire W can be accordingly enhanced. As a consequence, electric connectivity between the crimp terminal 10 and the conductor Wa can be improved.

Moreover, in addition to having the half pipe region 31, the cover 30A has the annular region 32. Hence, the cover 30A can be fitted to the end of the electric wire W so as not to fall by fitting the annular region 32 around the outer periphery of the conductor Wa of the electric wire W. Thus, workability achieved when the end of the electric wire W is set on the crimp terminal 10 can be enhanced. Furthermore, the annular region 32 is fitted around the outer periphery of the conductor Wa, whereby the step "d" existing between the insulating sheath Wb and the conductor Wa of the electric wire W can be reduced by means of the thickness of the annular region 32. Accordingly, crimping of the electric wire crimping pieces (the conductor crimping pieces 22 and the sheath crimping pieces 24) of the electric wire connecting region 12 becomes easy to perform.

Since the interior surface of the half pipe region 31 is opened, it is easy to form the serrations 36 and 37 on the interior surface of the half pipe region 31. Accordingly, enhancing contact conduction between the cover 30A and the conductor Wa of the electric wire W is also easy. When coupled with working action of the serrations 18 provided on the interior surface of the electric wire connecting region 12 of the crimp terminal 10, the serrations 36 and 37 enable much greater enhancement of electric connection performance.

Moreover, in the connecting structure of the present embodiment, the cover 30A is made by pressing a single plate material. There is ensured the clearance gap 32*a* between the peripheral ends of the plate material circularly rounded to define the annular region 32. Therefore, it is possible to assure a degree of freedom achieved when the annular region 32 is fitted around the conductor Wa of the electric wire W and ease of collapse achieved when the electric wire crimping pieces (the conductor crimping pieces 22 and the sheath crimping pieces 24) of the crimp terminal 10 are crimped.

In the present embodiment, the serrations 19 are provided on the interior surface of the sheath crimping region 15, as well. Therefore, the insulating sheath Wb comes to bite into the serrations 19 in a crimped state. Accordingly, adhesion between the interior surface of the sheath crimping region 15 and the sheath Wb of the electric wire W can be enhanced. Further, the serrations 19 extend in a direction crossing the longitudinal direction of the electric wire W. Hence, even if a water content attempts to enter the conductor Wa at the back of the sheath crimping region 15 from its rear end, a pathway for intrusion of the water content can be blocked by means of a complicate structure resulting from the serrations 19 biting into the insulating sheath Wb, to thus impede intrusion of the water content. Thus, an attempt can be made to hinder corrosion of the conductor Wa.

Furthermore, in the present embodiment, the open area existing between the conductor crimping region 14 and the sheath crimping region 15 is covered with the casing walls 17 provided in an area ranging from the conductor crimping pieces 22 of the conductor crimping region 14 to the sheath crimping pieces 24 of the sheath crimping region 15. Hence, an extent to which the conductor Wa of the electric wire W is exposed can be lessened, which also enables prevention of intrusion of the water content into the conductor Wa.

Although the present embodiment has provided an exemplification in which the cover 30A manufactured by pressing a single plate material is used, another cover manufactured by cutting a cylindrical pipe can also be used.

Figure 5:
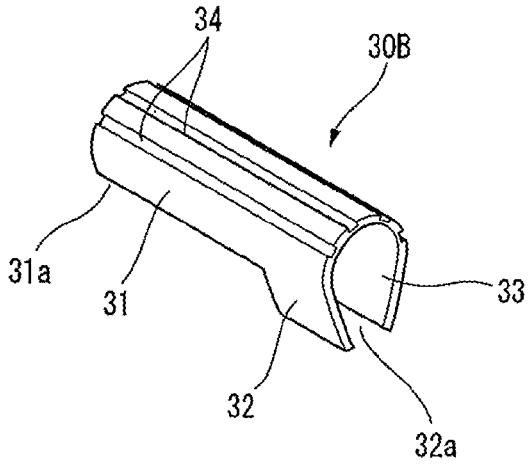
FIG. 5 is a perspective view showing another example of the cover.

As shown in FIG. 5, a cover 30B having groove-like irregularities 34 that run on the outer periphery of the half pipe region 31 and the outer periphery of the annular region 32 along the axial direction can also be used as the cover employed in the present invention. When the cover 30B is used, the interior surfaces of the respective conductor crimping pieces 22 bite into the groove-like irregularities 34 of the cover 30B when the conductor crimping pieces 22 of the crimp terminal 10 are crimped. Hence, adhesion between the conductor crimping pieces 22 and the cover 30B can be enhanced, and slack in the conductor crimping pieces 22, which would otherwise arise when the crimp terminal 10 is exposed to temperature shock, can be prevented. Moreover, a sealing property of the cover can also be enhanced, so that an effect of preventing intrusion of the water content into the conductor can be enhanced.

Figure 6:
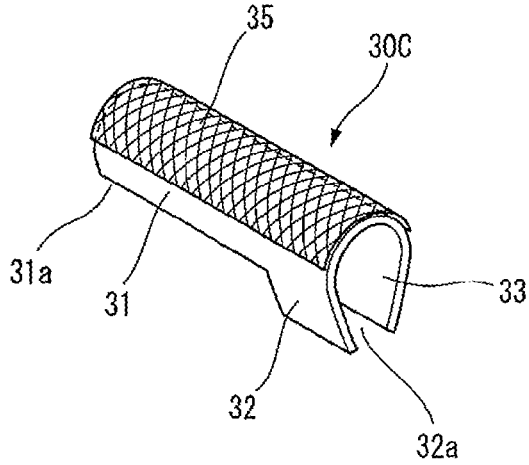
FIG. 6 is a perspective view showing still another example of the cover.

Furthermore, as shown in FIG. 6, there can also be used a cover 30C formed by coating the outer periphery of the half pipe region 31 and the outer periphery of the annular region 32 with a rubber layer 35. In a case where the cover 30C is used, the conductor crimping pieces 22 bite into the rubber layer 35 of the cover 30C when the conductor crimping pieces 22 of the crimp terminal 10 are crimped. Hence, adhesion between the conductor crimping pieces 22 and the cover 300 can be enhanced, and slack in the conductor crimping pieces 22, which would otherwise arise when the crimp terminal 10 is exposed to thermal shock, can be prevented. Moreover, the sealing property of the cover is also enhanced, so that the effect of preventing intrusion of the water content into the conductor can be improved.

Figure 7A:
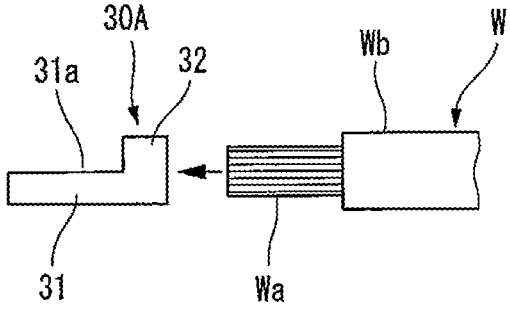
FIGS. 7(*a*) and 7(*b*) are views showing another modification of the case achieved when the cover is fitted around the end of the electric wire, FIG. 7(*a*) is a side view showing a state achieved before the cover is fitted to the end of the electric wire, and FIG. 7(*b*) is a side view showing a state achieved after fitting of the cover.
Figure 7B:
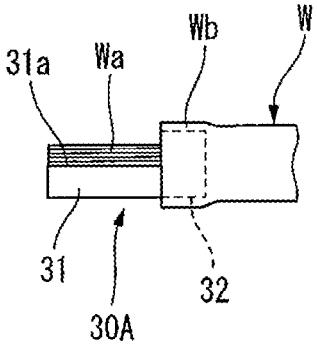

Further, the present embodiment has provided the case where the end face of the annular region 32 of the cover 30A butts against the end face of the insulating sheath Wb. However, as shown in FIG. 7(*a*) and FIG. 7(*b*), the annular region 32 of the cover 30A can also be inserted into space between the conductor Wa and the insulating sheath Wb of the electric wire W. The cover 30A employed in this case has an axial length equal to a length from the leading end of the conductor Wa of the end of the electric wire W to the insulating sheath Wb. Further, an inner diameter of the annular region 32 is set to a size that enables exact insertion of the conductor Wa of the electric wire W into the annular region 32. In addition, a thickness of the annular region 32 is set to a thickness that makes it possible to forcefully insert the annular region 32 into a clearance gap between the conductor Wa of the electric wire W and the sheath Wb.

During insertion of the cover 30A, the end of the cover 30A is inserted into a clearance gap between the conductor Wa and the sheath Wb in an area of the end of the electric wire W provided with the sheath Wb while the cover 30A is being pressed toward the sheath Wb with the end of the sheath Wb being flipped, thereby letting a predetermined length of the cover 30A overlap the end of the sheath Wb. The length of the lap is set to the same dimension as or a dimension slightly greater than the width of each of the sheath crimping pieces 24. The sheath crimping pieces 24 are crimped to the lap. Thus, a pathway along which the water content intrudes from the outside to the conductor Wa can be transformed into a labyrinthine narrow pathway including complicate bands. Accordingly, intrusion of the water content can be restricted more rigorously.

Figure 8:
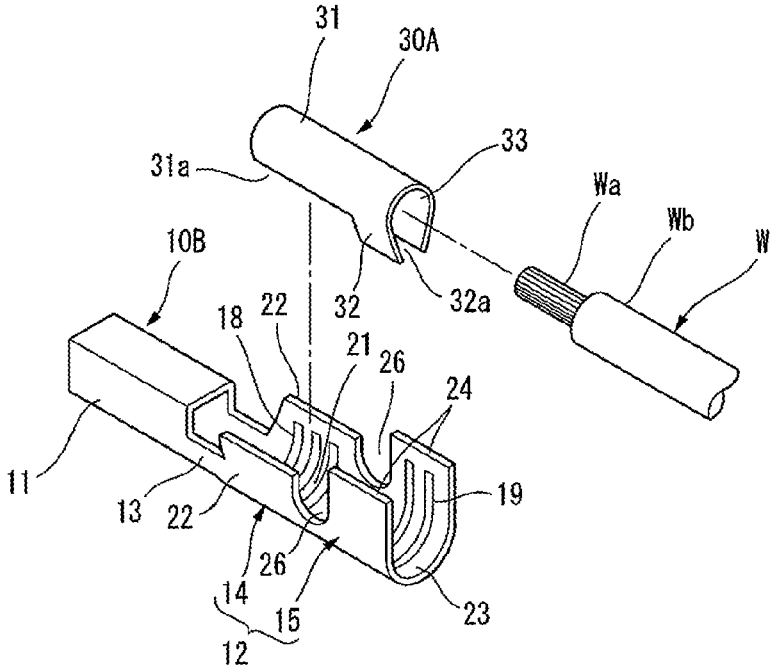
FIG. 8 is an exploded perspective view showing a state achieved before crimping of a terminal of another embodiment of the present invention.

The present embodiment shows the case where there is used as the crimp terminal a terminal in which a clearance space between the conductor crimping pieces 22 and the sheath crimping pieces 24 is joined up with each other by means of the casing wall 17. However, as shown in FIG. 8, there can also be used a crimp terminal 10B of normal shape in which a U-shaped cutout 26 exists between the conductor crimping pieces 22 and the sheath crimping pieces 24.

The present invention is not restricted to the embodiment and accordingly susceptible to transformations, improvements, and the like. In addition, the constituent elements described in connection with the embodiment are arbitrary in terms of materials, shapes, sizes, numbers, locations, and others, so long as the present invention can be accomplished by means of the constituent elements.

A configuration of a cover of another embodiment is hereunder described in detail.

Figure 9A:
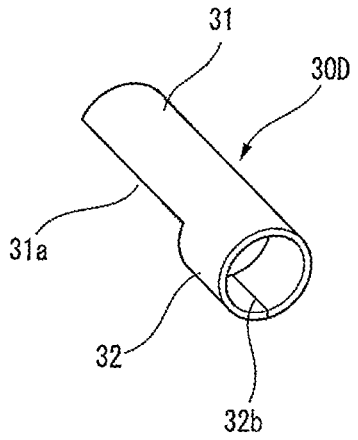
FIG. 9(*a*) to FIG. 9(*c*) are perspective views showing respective examples achieved when an annular region of the cover assumes a closed circular shape.
Figure 9B:
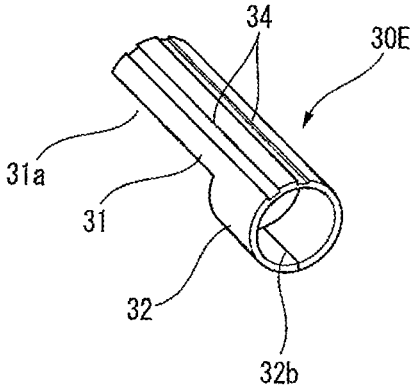
Figure 9C:
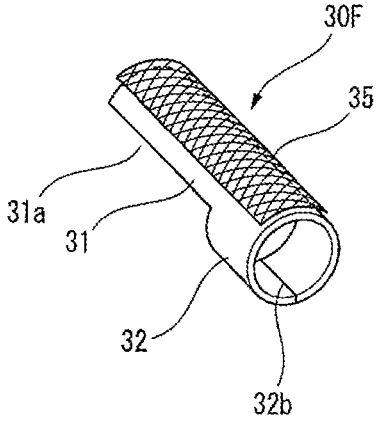

In the present embodiment, explanations have been provided for; for instance, the case where there are used the covers 30A to 30C in which the clearance gap 32*a* exists between peripheral ends of the annular region 32. However, as shown in FIGS. 9(*a*) to 9(*c*), there can also be used covers 30D to 30F in which peripheral ends 32*b* butt against each other such that the clearance gap does not exist in the annular region 32. In this case, the cover 30D shown in FIG. 9(*a*) corresponds to the cover 30A shown in FIG. 2 in which the ends 32*b* of the annular region 32 of the cover 30A merely butt against each other. The cover 30E shown in FIG. 9(*b*)

corresponds to the cover 30B shown in FIG. 5 in which the ends 32*b* of the annular region 32 of the cover 30B merely butt against each other. The cover 30F shown in FIG. 9(*c*) corresponds to the cover 30C shown in FIG. 6 in which the ends 32*b* of the annular region 32 of the cover 30C merely butt against each other.

Figure 10A:
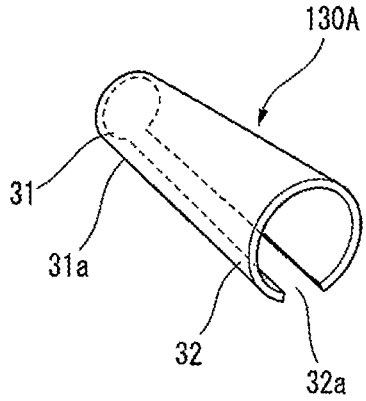
FIG. 10(*a*) to FIG. 10(*c*) are perspective views showing respective examples achieved when an area of the cover extending from a half pipe region to the annular region is tapered.
Figure 10B:
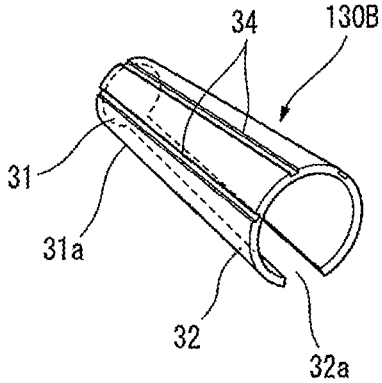
Figure 10C:
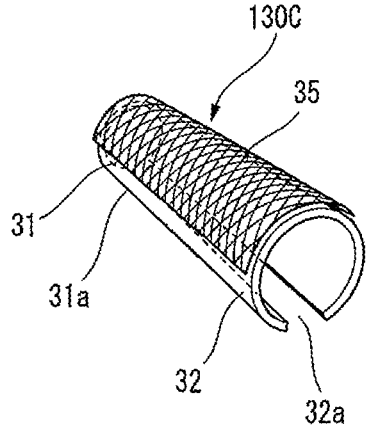
Figure 11A:
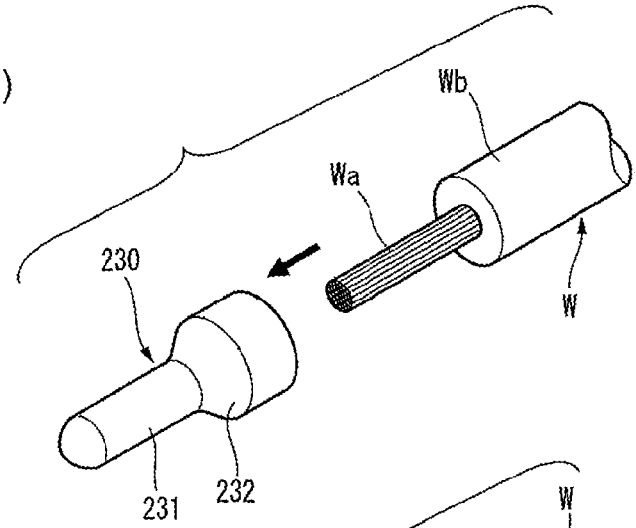
Fig.11(a) Prior Art
FIG. 11(*a*) to (*c*) are explanatory views of a structure for connecting an existing terminal to an electric wire, FIG. 11(*a*) is a perspective view showing a state in which an attempt is made to fit a cap to the end of the electric wire, FIG. 11(*b*) is a perspective view showing a state in which an attempt is made to set the end of the electric wire covered with the cap to a conductor crimp region of the terminal, and FIG. 11(*c*) is a perspective view showing a state in which conductor crimping pieces of the conductor crimp region of the terminal and the end of the conductor set in the conductor crimp portion are crimped together, thereby connecting the end to the conductor.
Figure 11B:
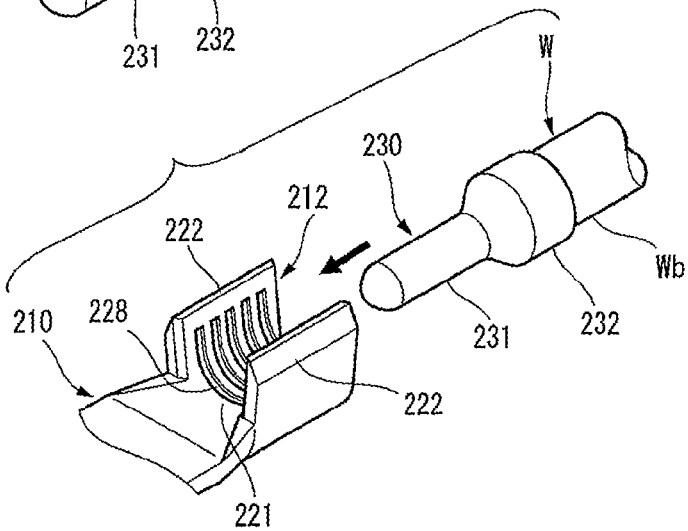
Fig.11(b) Prior Art
Figure 11C:
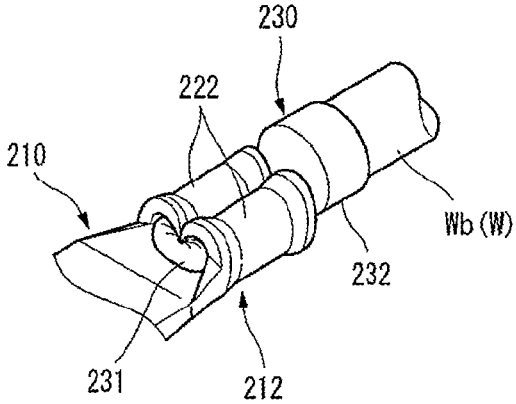
Fig.11(c) Prior Art

The embodiment has shown the case where both peripheral edges of the half pipe region 31 are parallel to each other in the axial direction. However, as shown in FIGS. 10(*a*) to (*c*), there can also be used covers 130A to 130C in which both peripheral edges of an area ranging from the half pipe region 31 to the annular region 32 come into edges that are continually parallel to each other along the axial direction of the cover and in which the covers in their entirety are substantially tapered. In this case, the cover 130A shown in FIG. 10(*a*) corresponds to a modification of the cover 30A shown in FIG. 2; the cover 130B shown in FIG. 10(*b*) corresponds to a modification of the cover 30B shown in FIG. 5; and the cover 130C shown in FIG. 10(*c*) corresponds to a modification of the cover 30C shown in FIG. 6.

A cover having a polygonal cross section can also be used as a cover to be used in the present invention.

Although the present invention has been described in detail by reference to the specific embodiment, it is manifest to those who are versed in the art that the present invention be susceptible to various alterations or modifications without departing the spirit and scope of the present invention. The present patent application is based on Japanese Patent Application (JP-2010-112484) filed on May 14, 2010, the subject matters of which are incorporated herein by reference in its entirety.

DESCRIPTIONS OF THE REFERENCE NUMERALS AND SYMBOLS

W ELECTRIC WIRE
Wa CONDUCTOR
Wb INSULATING SHEATH
10, 10B CRIMP TERMINAL
12 ELECTRIC WIRE CONNECTING REGION
14 CONDUCTOR CRIMPING REGION
15 SHEATH CRIMPING REGION
18, 19 SERRATION
21 BOTTOM PLATE
22 CONDUCTOR CRIMPING PIECE (ELECTRIC WIRE CRIMPING PIECE)
23 BOTTOM PLATE
24 SHEATH CRIMPING PIECE (ELECTRIC WIRE CRIMPING PIECE)
30A, 30B, 30C, 30D, 30E, 30F COVER
31 HALF PIPE REGION
31*a* OPEN AREA
32*a* CLEARANCE SPACE
36, 37 SERRATION
130A, 130B, 130C COVER

The invention claimed is:

1. A structure for connecting an electric wire to a crimp terminal, the crimp terminal having a front portion having an electric connecting region that is to be connected with a counterpart terminal; and a rear portion having an electric wire connecting region that is formed so as to assume a substantially U-shaped form when viewed in cross section, and a bottom plate and a pair of electric wire crimping pieces extended upward from both side edges of the bottom plate and that are folded inward so as to wrap an end of an electric wire to be connected so as to bring the end of the electric wire into close contact with an upper surface of the bottom plate; the structure comprising:

a metallic cover having a half pipe region having a circular-arc cross sectional shape at one longitudinal end thereof and an annular region having a substantially circular cross sectional shape with peripheral edges separated by a clearance gap at other longitudinal end thereof, wherein the metallic cover is fitted to a conductor exposed by removal of an insulating sheath from the end of the electric wire so that the half pipe region is situated at a leading end of the conductor so as to cover a space above the conductor; and the annular region is fitted around an outer periphery of the conductor; and wherein in a state in which the end of the electric wire equipped with the cover is set on the bottom plate of the electric wire connecting region while the conductor exposed outside an open area of the half pipe region is oriented toward the bottom plate, the pair of electric wire crimping pieces of the electric wire connecting region are folded inward and crimped so as to crimp the end of the electric wire to the electric wire connecting region along with the cover, wherein the metallic cover has at least one serration on an interior surface of the cover which extends continuously across the circular-arc cross sectional shape of the half pipe region.

2. The structure for connecting the electric wire to the crimp terminal according to claim 1, wherein the half pipe region includes a semi-circular cross sectional shape which is positioned on the conductor so as to cover an upper half of a cross section of the conductor.

3. The structure for connecting the electric wire to the crimp terminal according to claim 1, wherein the cover is formed by pressing a single plate material to ensure the clearance gap between the peripheral edges of the plate material which are configured to be circularly rounded to make up the annular region.

4. The structure for connecting an electric wire to a crimp terminal according to claim 1, wherein more than one serration is provided the interior surface of the cover.

5. The structure for connecting an electric wire to a crimp terminal according to claim 3, wherein more than one serration is provided the interior surface of the cover.

6. The structure for connecting an electric wire to a crimp terminal according to claim 1, wherein the metallic cover if formed from a single metal plate such that the cover fully covers the exposed portion of the conductor such that intrusion of a content into the cover is prevented.

7. The structure for connecting an electric wire to a crimp terminal according to claim 1, wherein the at least one serration extends from a first side of the half-pipe region to a second side of the half-pipe region.

8. The structure for connecting an electric wire to a crimp terminal according to claim 7, wherein the first side and the second side are opposite sides of the half-pipe region in a direction perpendicular to a longitudinal direction of the electric wire, such that the at least one serration crosses the longitudinal direction of the electric wire.

* * * * *